US007632465B2

(12) United States Patent
Orha et al.

(10) Patent No.: US 7,632,465 B2
(45) Date of Patent: Dec. 15, 2009

(54) VESSEL TRAY

(75) Inventors: Tapani Orha, Hyvinkää (FI); Jarma Orha, Rajamäki (FI); Ari Jääskelainen, Helsinki (FI); Arto Lahti, Tuusula (FI)

(73) Assignee: Thermo Fisher Scientific Oy, Vantaa (FI)

( * ) Notice: Subject to any disclaimer, the term of this patent is extended or adjusted under 35 U.S.C. 154(b) by 0 days.

(21) Appl. No.: 10/581,249

(22) PCT Filed: Dec. 3, 2004

(86) PCT No.: PCT/FI2004/000734

§ 371 (c)(1),
(2), (4) Date: Apr. 13, 2007

(87) PCT Pub. No.: WO2005/054065

PCT Pub. Date: Jun. 16, 2005

(65) Prior Publication Data

US 2007/0217958 A1 Sep. 20, 2007

(30) Foreign Application Priority Data

Dec. 4, 2003 (FI) ..... 20031773

(51) Int. Cl.
*B01L 3/02* (2006.01)

(52) U.S. Cl. ..... 422/100

(58) Field of Classification Search ..... 422/100
See application file for complete search history.

(56) References Cited

U.S. PATENT DOCUMENTS

| | | | | |
|---|---|---|---|---|
| 3,390,783 | A | 7/1968 | Quackenbush, Jr. | |
| 5,080,232 | A * | 1/1992 | Leoncavallo et al. | 206/446 |
| 5,096,672 | A | 3/1992 | Tervamaki et al. | |
| 5,470,536 | A | 11/1995 | Jarvimaki | |

FOREIGN PATENT DOCUMENTS

| | | |
|---|---|---|
| EP | 0 022 988 | 1/1981 |
| EP | 0 415 307 A2 | 3/1991 |
| EP | 0 597 288 A1 | 5/1994 |
| EP | 0 688 602 | 1/1995 |
| EP | 0 649 679 | 4/1995 |
| GB | 2 064 998 | 6/1981 |

OTHER PUBLICATIONS

International Search Report.

* cited by examiner

*Primary Examiner*—Michael A Marcheschi
*Assistant Examiner*—Bobby Ramdhanie
(74) *Attorney, Agent, or Firm*—Nixon & Vanderhye P.C.

(57) ABSTRACT

The invention relates to a tray for sample vessels comprising a plurality of orifices (2) in matrix configuration. One orifice has two positioning walls (10) defining a positioning corner. In addition, the orifice is provided with a pushing means (13), such as a flexible pushing means, which presses a sample vessel inserted into the orifice towards the positioning corner.

11 Claims, 3 Drawing Sheets

VESSEL TRAY

Figure 1:
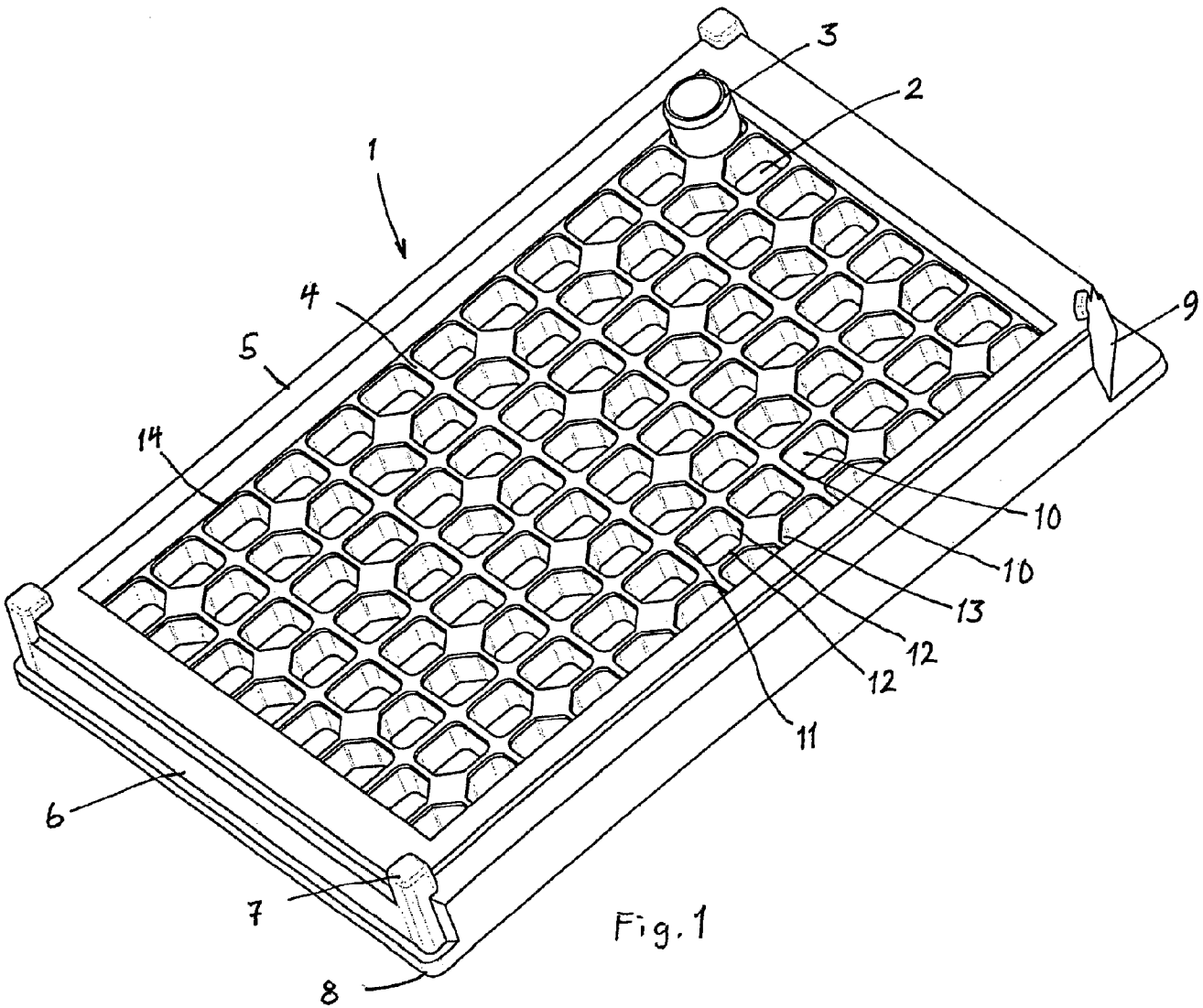

This application is the US national phase of international application PCT/FI2004/000734 filed 3 Dec. 2004 which designated the U.S. and claims benefit of FI 20031773, dated 4 Dec. 2003, the entire content of which is hereby incorporated by reference.

FIELD OF TECHNOLOGY

The invention relates to liquid handling in laboratories and is directed to a tray in which sample vessels are placed. The invention can be used in various chemical methods, such as determination or purification methods, for instance in clinical laboratories.

TECHNICAL BACKGROUND

Plates comprising a plurality of sample vessels in matrix configuration are commonly used for handling liquid samples in laboratories. A common standard comprises a "microtitration plate" including 8*12 vessels (i.e. wells or cuvettes) at 9 mm intervals. Plates comprising a support with locations for placing the wells are also commonly used. The wells may be discrete or form arrays of several wells each. The arrays may particularly consist of single-row strips. The strips may also be such from which wells are detachable for use in the number desired in each case.

U.S. Pat. No. 5,096,672 discloses a support for a microtitration plate comprising square orifices for wells. On one side of each orifice a flexible tongue is provided for pressing a well inserted into the orifice against the opposite wall. In this manner, the wells will remain in position on the support. U.S. Pat. No. 5,470,536 describes a similar support and a well for use together with the support, the well comprising additionally planar locking surfaces on opposite sides. When rotated about its vertical axis in the orifice, the well will be locked into the desired position with still higher precision.

GENERAL DESCRIPTION OF THE INVENTION

A vessel tray as described in claim 1 has now been invented. The other claims describe a number of preferred embodiments of the invention.

The tray of the invention comprises a plurality of orifices in matrix configuration, preferably forming several rows, each row comprising a plurality of orifices. Each orifice has a positioning corner, in which the positioning walls of the orifice define a concave angle, such as a right angle. The positioning walls may be planar. The orifice is also connected with a pushing means, such as a flexible pushing means, which pushes a vessel placed in the orifice against the positioning corner. In this manner, a vessel that is symmetrical, such as circular, in cross-section will always be positioned exactly in the desired position and will remain in this position. The vessel does not need to be rotated in the orifice.

The pushing means may be a support wall opposite the positioning corner. The tray may have an upper surface, to which the upper edge of the support wall may be attached. The orifice may have side walls, to which the lateral edges of the support wall may be attached at the lateral edge of the side wall. Each orifice may have a support wall of its own. The support wall may be inclined towards the centre of the orifice. The support wall may also be straight, and then the vessel is accordingly tapered downwardly. It is also possible to provide both an inclined support wall and a tapered vessel.

The orifice may comprise two positioning walls defining the positioning corner. Side walls, separated by an intermediate support wall, may extend the positioning walls. The walls of the orifice may form a continuous surface encircling the orifice. The positioning walls and also the side walls may be inclined towards the centre of the orifice.

The positioning wall may be provided at the outer edge of the orifices at the matrix edge. The positioning walls of the outer edge may form a periphery around the matrix.

The orifices may be disposed in square arrays of four orifices each, starting from the matrix corner, with the support means located at the centre of the array.

A vessel can be placed in the orifice e.g. with its upper edge remaining above the upper edge of the orifice or at level with the upper edge of the orifice. The vessel or the orifice may comprise means for settling the vessel at the same height in the orifice each time. To this end, the vessel may be provided with an outwardly directed ledge engaging the edges of the orifice, or the orifice may comprise an inwardly oriented notch engaging the bottom of the vessel.

DRAWINGS

Figure 5:
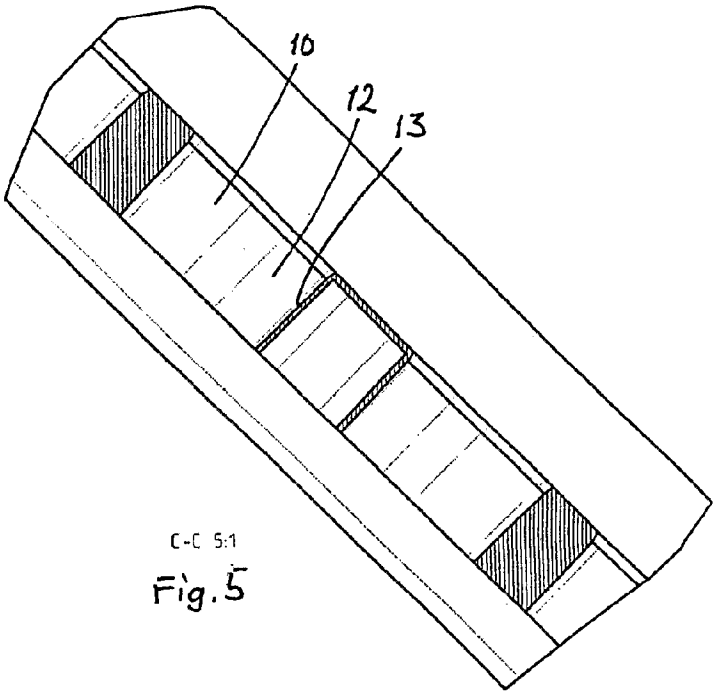
Figure 4:
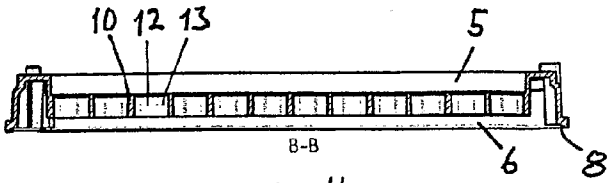
Figure 2:
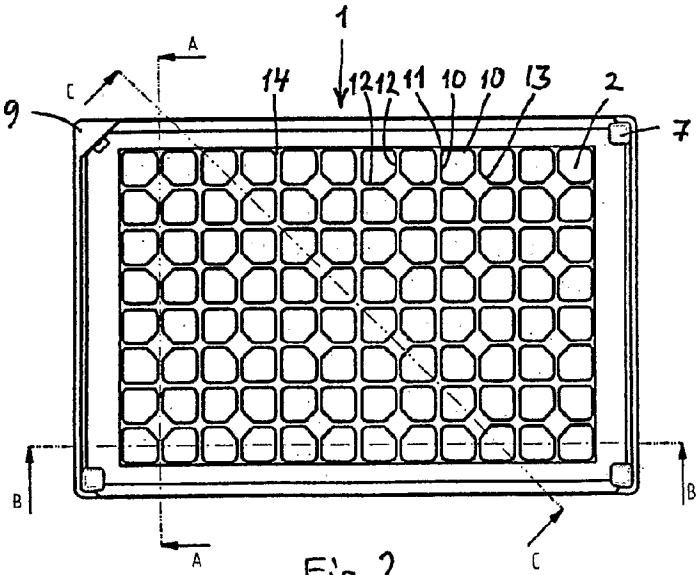
Figure 3:
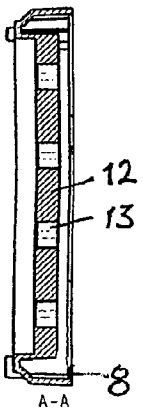
Figure 6:
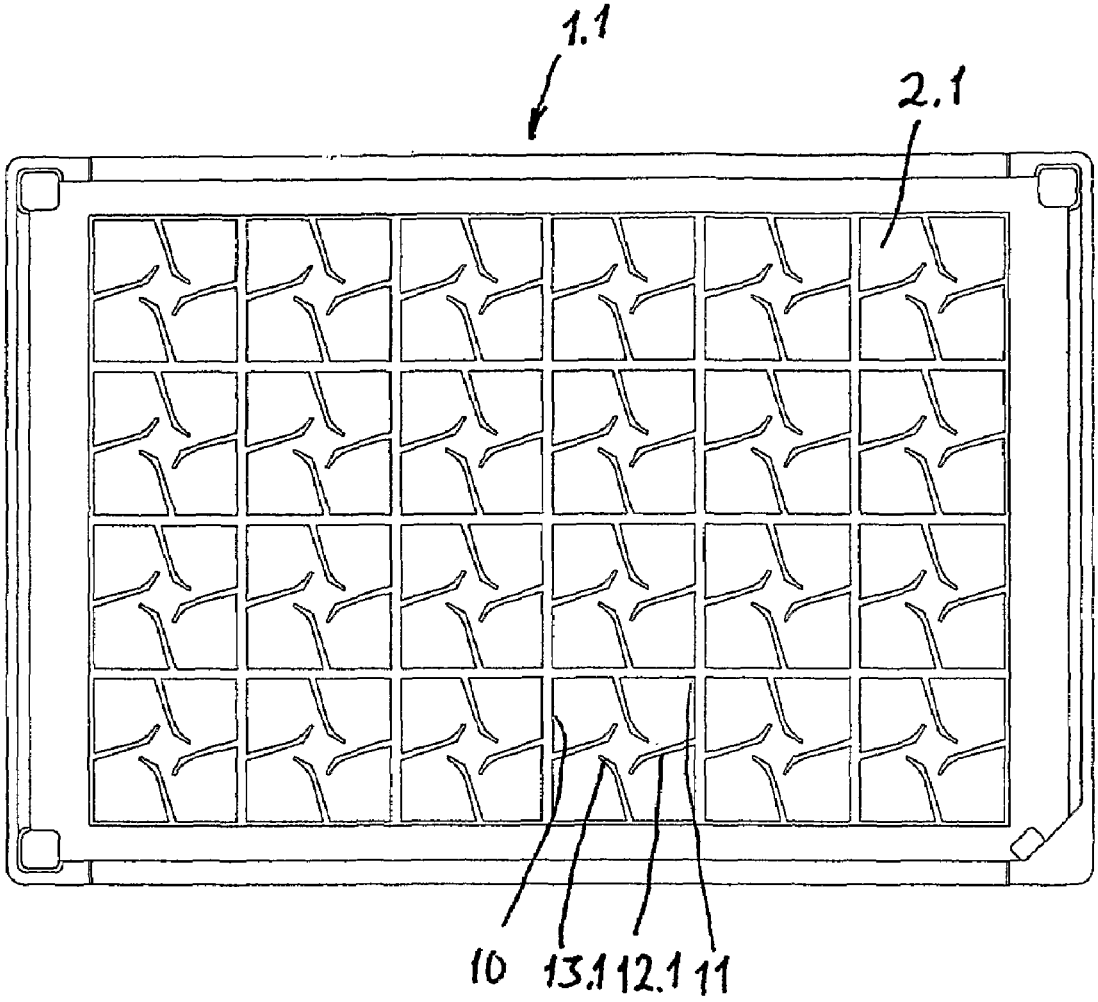

The accompanying drawings pertain to the written description of the invention and relate to the detailed description of a number of embodiments of the invention given below. In the drawings FIG. 1 shows an axonometric upper view of a vessel tray FIG. 2 is a top view of the same tray and FIGS. 3, 4 and 5 show FIG. 2 in cross-sections FIG. 6 illustrates another vessel tray.

DETAILED DESCRIPTION OF A NUMBER OF EMBODIMENTS OF THE INVENTION

A number of embodiments of the invention are explained in further detail below.

The tray 1 comprises 8*12 orifices 2 with a 9 mm distribution in a rectangular matrix under microtitration standards, the tray accommodating e.g. circular wells 3. The orifices are surrounded by a continuous upper surface 4 at level with their upper edge, the upper surface being surrounded by a higher border 5, from which walls 6 surrounding the tray extend downwardly, the tray being supported by the walls. At the upper corners of the tray, protrusions 7 are provided positioned relative to the corners 8 of the lower edge. This allows trays to be stacked on top of each other with high precision. At one corner, a notch 9 is provided for placing the tray turned only in a certain position into an analyser, for instance.

The orifice 2 comprises, starting from the upper surface 4 downwardly, two planar positioning walls 10, whose upper edges are at mutually right angles. The positioning walls form a positioning corner 11. The positioning walls join planar side walls 12, whose upper edges are perpendicular to the upper edges of the positioning walls. The side walls join a planar support wall 13 provided opposite the positioning corner. Adjacent orifices share the intermediate positioning walls. Accordingly, the orifices also have the intermediate side walls in common. Each support wall is attached at its lateral edges only to the side walls of the same orifice. The surface and lower edge of the support wall are detached from the well located cornerwise next to this. The support wall is slightly inclined towards the centre of the orifice, and hence the orifice is tapered downwardly. The orifices provided at the matrix edge comprise a positioning wall at their outer edge. At the outer edge, the positioning walls join each other, forming a continuous periphery 14 around the matrix.

The well 3 is dimensioned with its lower end passing exactly through the upper end of the orifice 2, however, with the well pressed further into the orifice, the support wall 13 starts pressing the well against the positioning wall 10. Guided by the positioning walls, the well will always settle exactly in the same position towards the positioning corner 11. The outer surface of the well is slightly tapered downwardly, thus contributing to the generation of compressive force.

The well 3 may comprise a notch or a ledge that bears against the upper edge of the orifice 2. In this manner, the well will always be positioned exactly at the same height. In a strip formed of a plurality of wells, the bridge connecting the wells will act as such positioning means.

The positioning corner 11 and also the corners formed of the positioning walls 10 and the side walls are slightly rounded. The rounded shape must naturally not extend into contact with the well.

The orifices 2 are placed, starting from the matrix corner, in square arrays of four orifices each, with the support walls 13 located at the centre of one array.

The support wall 13 preferably has suitable elasticity for the well 3 to be fixed into the orifice 2 with adequate friction, yet for the well to be readily removable. The elasticity of the support wall is achieved by selecting a suitable material and wall thickness.

In addition, the positioning walls 10 and the side walls 12 may be slightly inclined towards the centre of the orifice.

The tray 1.1 has an optional configuration, with the orifices 2.1. also disposed in square arrays of four orifices each, starting from the matrix corner. The side wall 12.1 is a flexible vertical strip starting from the positioning wall 10. One side wall of each orifice is directed towards this orifice, whereas the other side wall is directed away from the orifice. The free edge of each side wall is bent towards the orifice, forming the support wall 13.1 of this orifice, the support wall pressing the well against the positioning corner 11. In each array, the side walls are turned in the same direction.

The trays may be appropriately manufactured of injection-moulded plastic.

The trays are particularly useful for use with discrete wells. However, the tray can also be combined with entities formed of a plurality of wells, such as strips.

The invention claimed is:

1. A tray for sample vessels, comprising:

an upper surface with a plurality of orifices arranged in respective matrix configurations of four orifices forming a square, wherein each of the orifices accommodates one sample vessel and comprises two straight planar positioning walls which form a right angle and define a positioning corner, wherein each positioning corner of an orifice in a matrix configuration establishes a respective corner of the square, and wherein each of the orifices includes a planar flexible support wall positioned at a center of the square of each respective matrix configuration so as to be located opposite to the positioning corner of the orifice, the flexible support wall having an upper edge, two lateral edges and a lower edge, the upper surface of the tray joining the upper edge of the support wall, wherein the flexible support wall of the orifices elastically presses a sample vessel inserted into the orifice towards the positioning corner thereof, and wherein each of the orifices has at least one planar side wall joining a lateral edge of a respective flexible support wall to a lateral edge of a respective one of the positioning walls.

2. A tray as defined in claim 1, in which each of the orifices is provided with a separate support wall.

3. A tray as defined in claim 1, in which the positioning walls, the at least one side wall and the flexible support wall of each orifice encircle the orifice peripherally.

4. A tray as defined in claim 1, in which the flexible support wall is inclined towards a center of the orifice.

5. A tray as defined in claim 1, wherein orifices at an outer edge of a respective matrix configuration include outwardly directed positioning walls.

6. A tray as defined in claim 5, in which the outwardly directed positioning walls of the orifices located at the outer edge of a respective matrix configuration join each other thereby forming a continuous periphery around the matrix configuration.

7. A tray for sample vessels comprising:

multiple orifice arrays, wherein each orifice array consists of four orifices arranged to form a square, and wherein each of the four orifices in an orifice array has a positioning corner which establishes a respective corner of the square, and wherein each of the orifices in the orifice arrays is defined by a pair of planar positioning walls joined to one another along an edge thereof to define the positioning corner, and wherein each of the orifice arrays includes a pushing means positioned centrally in the orifice array for elastically pushing a sample vessel inserted into an orifice in a direction toward the positioning corner thereof at a respective corner of the square, wherein the pushing means includes planar elastic support walls each positioned in opposition to a positioning corner of a respective orifice in the orifice array.

8. A tray as in claim 7, wherein each of the orifices includes at least one planar side wall having lateral edges which join a respective one of the positioning walls to the support wall thereof.

9. A tray as in claim 7, wherein each of the orifices includes a pair of side walls, each of the side walls having lateral edges joining respective ones of the positioning walls to the support wall thereof.

10. A tray as in claim 9, wherein respective positioning walls, side walls and a supporting wall are joined to one another so as to define a periphery of each orifice in the orifice array.

11. A tray as in claim 8, wherein the at least one side wall has an inwardly bent free edge which defines the support wall.

* * * * *